US006684926B2

(12) United States Patent
Matechuk

(10) Patent No.: US 6,684,926 B2
(45) Date of Patent: Feb. 3, 2004

(54) HAND APPLICATOR FOR ADHESIVE TAPE

(76) Inventor: Edward Matechuk, 15187-93 Ave., Surrey, BC (CA), V3R 7A7

( * ) Notice: Subject to any disclaimer, the term of this patent is extended or adjusted under 35 U.S.C. 154(b) by 12 days.

(21) Appl. No.: 09/874,250

(22) Filed: Jun. 6, 2001

(65) Prior Publication Data

US 2002/0185234 A1 Dec. 12, 2002

(51) Int. Cl.[7] ..... B32B 31/00
(52) U.S. Cl. ..... 156/577; 156/579; 156/582
(58) Field of Search ..... 156/574, 577, 156/579, 582

(56) References Cited

U.S. PATENT DOCUMENTS

| | | | | | |
|---|---|---|---|---|---|
| 3,156,603 | A | | 11/1964 | Robinson | |
| 3,364,096 | A | * | 1/1968 | Hetes | 156/577 |
| 3,536,569 | A | | 10/1970 | Gosnell | |
| 3,537,942 | A | | 11/1970 | Kefalos | |
| 3,740,297 | A | | 6/1973 | Vidinsky | |
| 3,753,839 | A | * | 8/1973 | Funke et al. | 156/577 |
| 3,814,643 | A | | 6/1974 | Wagner | |
| 3,871,940 | A | | 3/1975 | Antonioni | |
| 3,900,362 | A | | 8/1975 | Schaffer | |
| 3,935,758 | A | | 2/1976 | Polzin et al. | |
| 3,969,180 | A | | 7/1976 | Ravesloot | |
| 4,067,510 | A | | 1/1978 | McGonagle | |
| 4,238,272 | A | | 12/1980 | Schleicher | |
| 4,341,587 | A | | 7/1982 | Regan | |
| 4,351,198 | A | | 9/1982 | Hansen | |
| 4,452,663 | A | * | 6/1984 | Heaton | 156/575 |
| 4,511,427 | A | | 4/1985 | Karliner et al. | |
| 4,576,674 | A | | 3/1986 | Le Tarte | |
| 4,623,421 | A | | 11/1986 | Cardin | |
| 4,667,891 | A | | 5/1987 | Pool | |
| 4,787,955 | A | * | 11/1988 | Nagel et al. | 156/488 |
| 4,818,329 | A | | 4/1989 | Tutas et al. | |
| 4,981,537 | A | | 1/1991 | Heil et al. | |
| 5,037,501 | A | | 8/1991 | Lawson | |
| 5,174,850 | A | | 12/1992 | Stefan | |
| 5,269,871 | A | | 12/1993 | Longworth et al. | |
| 5,316,614 | A | | 5/1994 | Phillips | |
| 5,445,703 | A | | 8/1995 | Steeves et al. | |
| 5,456,422 | A | * | 10/1995 | Longworth | 156/579 |
| 5,562,262 | A | | 10/1996 | Pennell | |
| 5,641,109 | A | | 6/1997 | Willoughby | |
| 5,755,918 | A | * | 5/1998 | Cetnar et al. | 156/360 |
| 5,800,668 | A | | 9/1998 | Bumb | |
| 5,814,184 | A | * | 9/1998 | Denkins | 156/577 |
| 5,921,450 | A | | 7/1999 | Robinson | |
| 6,209,609 | B1 | * | 4/2001 | Edwards et al. | 156/577 |
| 6,302,177 | B1 | | 10/2001 | Gruber | |
| D454,911 | S | | 3/2002 | Carlson et al. | |
| 6,536,498 | B1 | * | 3/2003 | Srinivasan et al. | 156/497 |

* cited by examiner

*Primary Examiner*—Mark A. Osele
(74) *Attorney, Agent, or Firm*—Michael J. Roman

(57) ABSTRACT

A portable apparatus for applying a masking tape to surfaces such as along the top edges of baseboards and the like, which comprises a housing having a tape holder adapted to receive a tape roll and a plurality of guiding sleeves rotatably mounted on a housing and together with a cutter assembly adopter to tear the tape.

5 Claims, 6 Drawing Sheets

HAND APPLICATOR FOR ADHESIVE TAPE

FIELD OF THE INVENTION

This invention relates to adhesive tape applying apparatus. In particular this invention relates to masking tape applying apparatus that are adapted to easy dispense of masking tape onto surfaces such as along the top edge surfaces of baseboards and the like before applying paints onto them.

BACKGROUND OF THE INVENTION

Adhesive tape comes in rolls in different widths and is designed to be applied on surfaces to be masked particularly in the painting and decorating industry. The tape has a gummy side, which causes it to have elasticity properties, which in turn makes it hard to cut, tear or apply in a straight line.

For anyone that has tried to apply adhesive tape to protect door and window casings, baseboards, etc, from paint that is applied to the walls, you will have experienced the frustration of applying the adhesive tape by hand. First it is very difficult to find the beginning of the tape end. Next, it is difficult to tear the tape and apply it uniformly to the trim that you are trying to protect with a sensitive pressure that will not allow the paint to bleed under the adhesive tape. Finally, after the painting is done you must remove the tape without pealing off the paint under the tape.

SUMMARY OF THE INVENTION

Hand-E-Masker addresses and solves the problems of the application of adhesive tape by hand or any other applicator that is currently on the market. It is designed to apply adhesive tape smoothly and easily with only the rubber bands of the rollers allowing sensitive pressure firmly to a surface to be masked. Therefore, stripping the tape is very easy as the tape is adhered only on both edges and not the entire width of the tape.

With the ease of installing a roll of adhesive masking tape on my invention and running the machine along the trim, the machine dispenses the masking tape in a uniform line that is required. With a push of a thumb the masking tape is neatly cut leaving a free end of the roll to begin the next application. The cutting blade in the retracted position allows handling of the machine without the fear of injury.

Hand-E-Masker is designed to use an adjacent wall or trim as a guide without marking or scarring of walls. An a extension handle will be available to be attached to the machine for applying adhesive tape to baseboards without having to get down on your hands and knees. The handle has a trigger to cut the tape. A additional kit will be made available to allow the machine to apply different widths of adhesive tapes.

The adjustable tension on tape wheel is to allow the operator while holding the machine with one hand, to pull a length of adhesive tape and cut the tape with the cutter to mask light switches, plug covers, or any other items that will require short pieces of tape, etc. The tension prevents the tape wheel from spinning and allowing the cutter to penetrate and cut the adhesive tape into short pieces when required.

Hand-E-Masker is designed to be easily operated by any do-it-yourself person and or tradesman which does not require any special skills. The simplicity of the invention may be easily manufactured and be sold at a low and reasonable cost to the potential consumer who will be the beneficiary of a tool which will save them precious time and frustration in applying adhesive masking tape.

Insert Consistatory Clauses

Other aspects of the invention will be appreciated by reference to the detailed description of the preferred embodiment and to the claims that follow.

BRIEF DESCRIPTION OF THE DRAWINGS

The preferred embodiment will be described by reference to the drawings thereof in which.

DETAILED DESCRIPTION OF THE PREFERRED EMBODIMENT OF THE INVENTION

Figure 1:
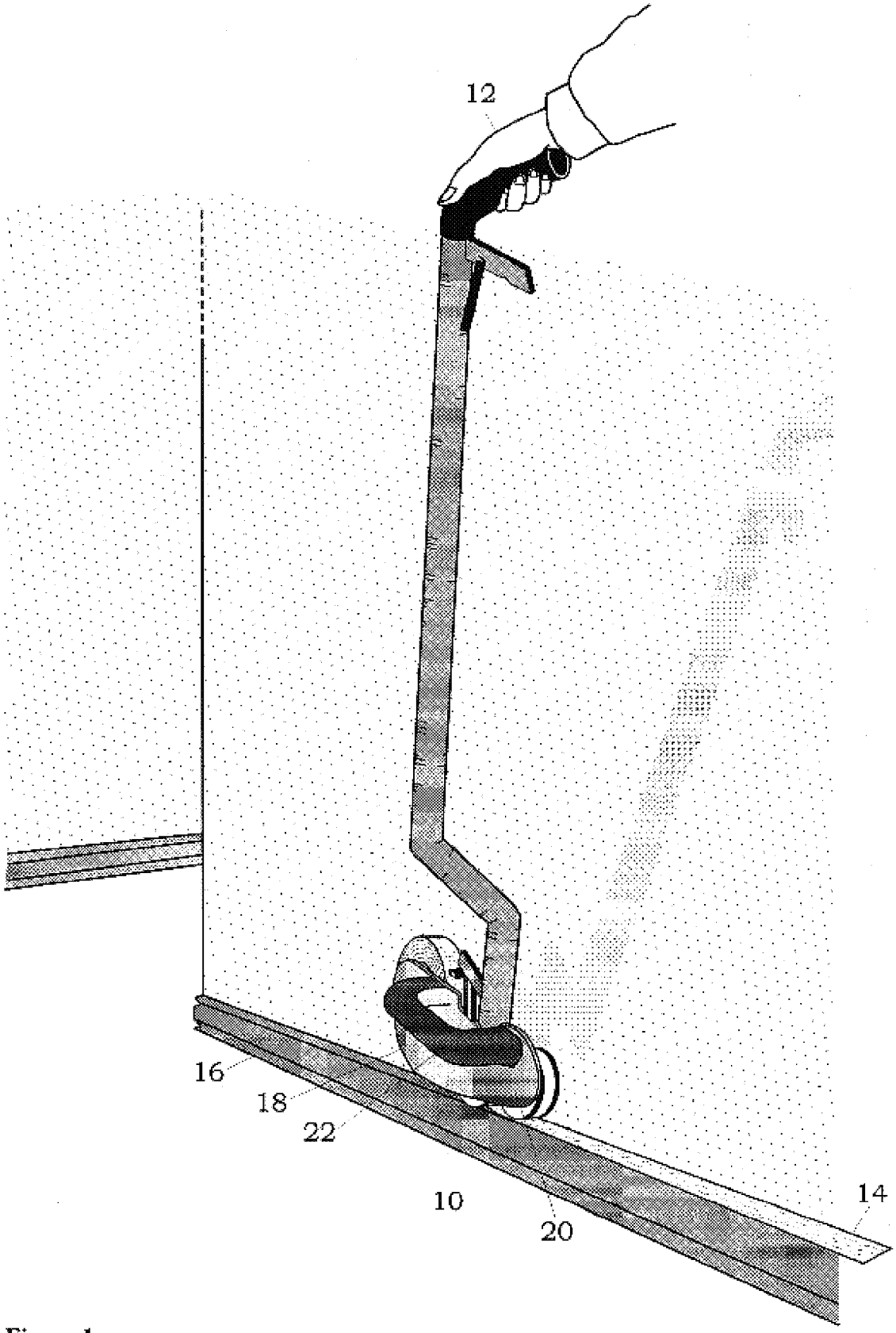
FIG. 1 is a perspective view of an embodiment of the instant invention constructed in accordance with the preferred embodiment.

The present invention is of a tape masking tool, or similar tool, which provides for the fast, easy and efficient applying of masking tape and the ease of removing it after use. The principle and operation of a hand-E-masker according to the present invention may be better understood with reference to the drawings and the accompanying description. Referring now to the drawings, in which like reference characters indicate corresponding elements throughout the several views, attention is first directed to FIG. 1 which illustrates a masker 10 in a use position grasped by the hand 12 of a user to apply masking tape 14 to the edge of baseboard 16. Masker 10 has a longitudinal housing 18 which includes a relatively flat portion 20 with a rearwardly extending handle 22 coupled thereto, which is operative for receiving, retaining and dispensing a roll of material, details of which will be further discussed shortly. It will be readily understood that although housing 18 has been herein specifically shown as having a generally longitudinal configuration, any preferred and suitable configuration may be used such as triangular, square, cylindrical, or some other selected geometric configuration without departing from the nature and scope of the instant invention as herein disclosed. Housing 18, including each of the forgoing named elements, is preferably constructed of a substantially rigid material such as plastic or other preferred and suitable material integrally formed of plastic in accordance with conventional injection moulding techniques, masker 10 may be formed having any preferred and selected width, height, and length, as desired to suit specific needs.

Figure 2:
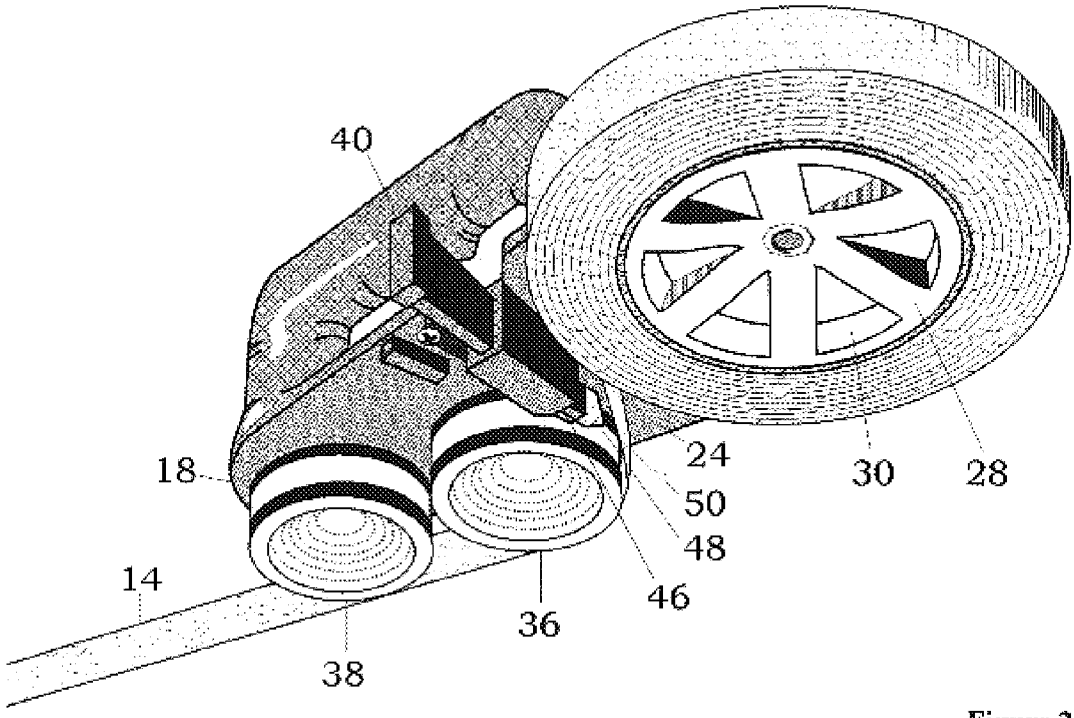
FIG. 2 is a perspective view of FIG. 1 without the extension.
Figure 3:
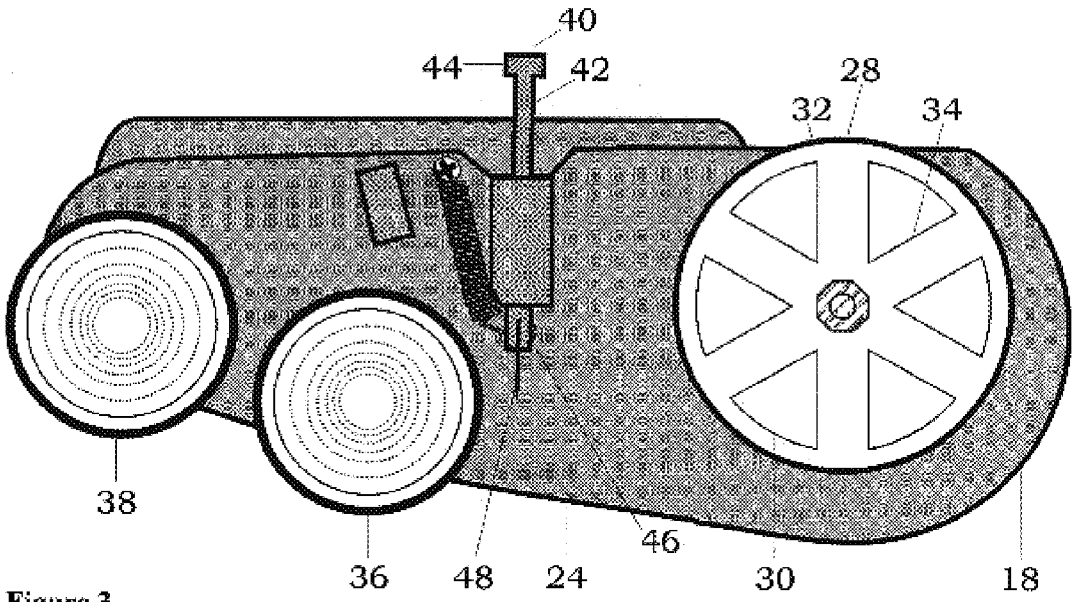
FIG. 3 is a side elevation view of the forward end of the device of FIG. 2, the roll of tape being removed for purpose of illustration.
Figure 4:
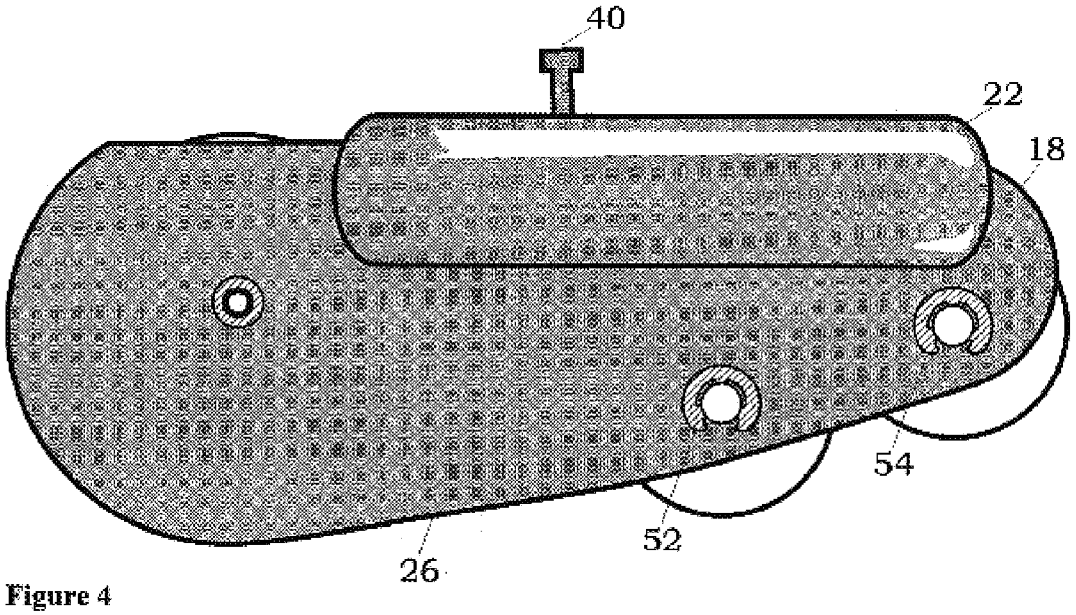
FIG. 4 is a side elevation view taken from the rearward end of the illustration of FIG. 2, the roll of tape being removed for purposes of illustration.

Housing 18 includes a forward portion 24 and a rearward portion 26, as further seen in FIGS. 2, 3 and 4. Referring more specifically to FIG. 2, illustrated is a preferred means by which masking tape roll holder 28 having six triangle openings 30 extending inward from outer surface 32 to inner surface 34 of holder 28 may be rotatably integral with forward portion 24 of housing 18 in accordance with conventional practice. It will be readily understood that although openings 110 have been herein specifically shown as having a generally triangle configuration, any preferred and suitable configuration may be used such as circle, square, generally, or some other selected geometric configuration and numbers of the openings without departing from the nature and scope of the instant invention as herein disclosed for reduced weight of the holder 28.

A plurality of guiding sleeves such as a first guiding sleeve 36 and a second guiding sleeve 38 may be mounted onto the forward portion 24 of housing 18 to press the dispensed masking tape 14 onto a desired surface. The first guiding sleeve 36 is mounted adjacent the holder 28 and the second guiding sleeve 38 is mounted adjacent the trailing end of the housing 18 and thereby facilitate urging of the unwinding tape 14 onto the subjacent surface along a desired line over both guiding sleeves 36, 38. Further, it is recommended to use single guiding sleeve masker for use in painting an automobile or the like such that being smaller in diameter to facilitate small angle applications laying down of the tape in corners and accurately along edges of the receiving surface for improved facilitated tape dispensing. A trigger 40 being a means of tearing the masking tape when it reaches the edge has a relatively rectangular slide body 42 with a thumb engagement head 44 and a cutter head portion 46 at the front end thereof connected thereto a steel blade 48 to provide a sharp pointed cutter tip 50. The steel blade 48 may be in the form of a razor blade or the like. In use, can be seen in FIG. 5, the operator may apply pressure downwardly through the trigger 40 by pressing downwardly with his thumb on the thumb engagement head 44 thereby causing the trigger 40 to be forced downwardly into engagement with a tape 14 extending between roll holder 28 and guiding sleeve 36 to shear the tape located therebetween. The pressure applied by the operator is released by moving the trigger upwardly. Rearward portion 26 of housing 18, can be seen in FIGS. 3 and 4, having a handle 12 and two c-clips to fix two guide sleeves 36 and 38 onto housing 18.

Figure 6:
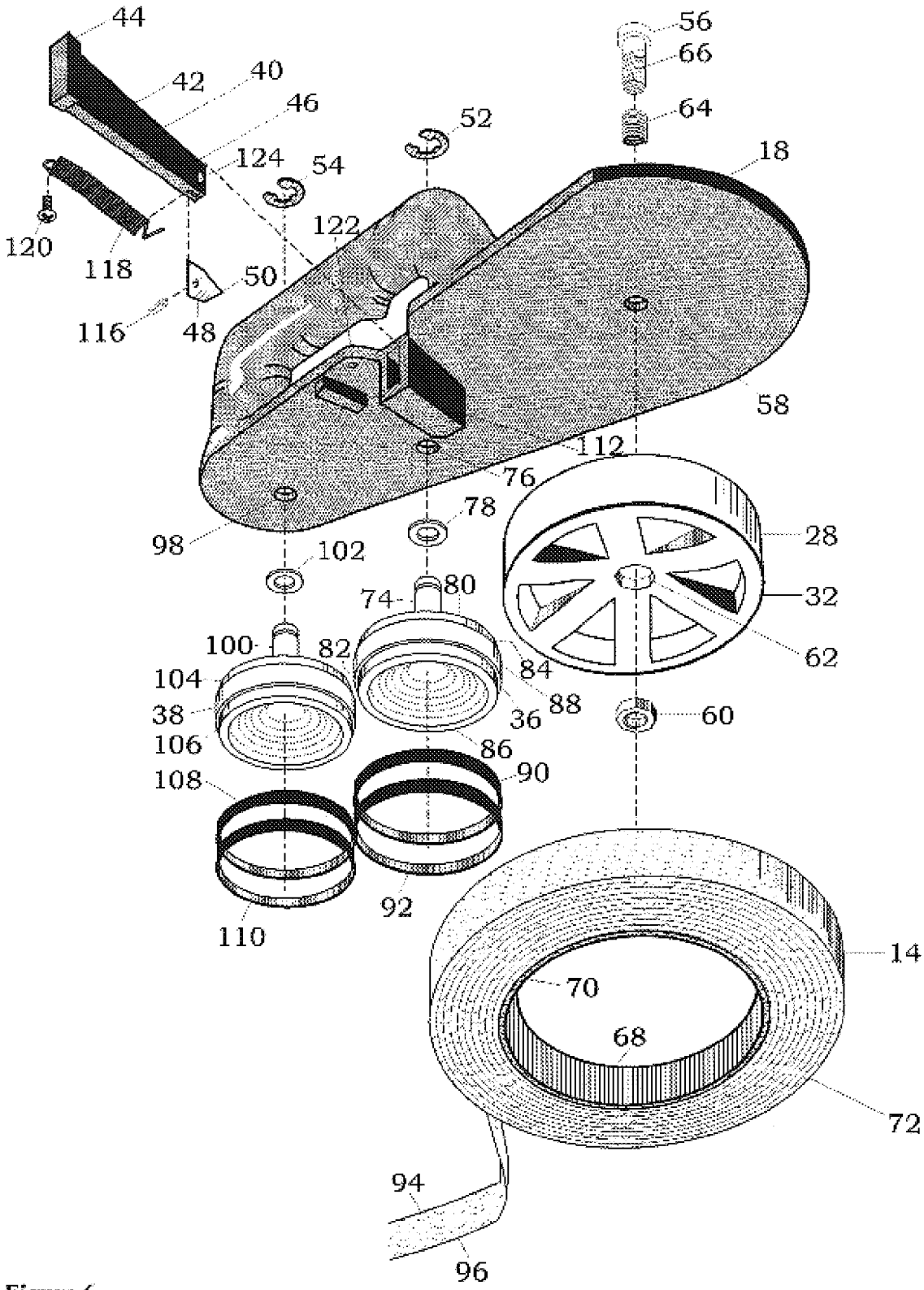
FIG. 6 is a perspective view of the applicator of FIG. 1 shown as it would appear in use.
Figure 7:
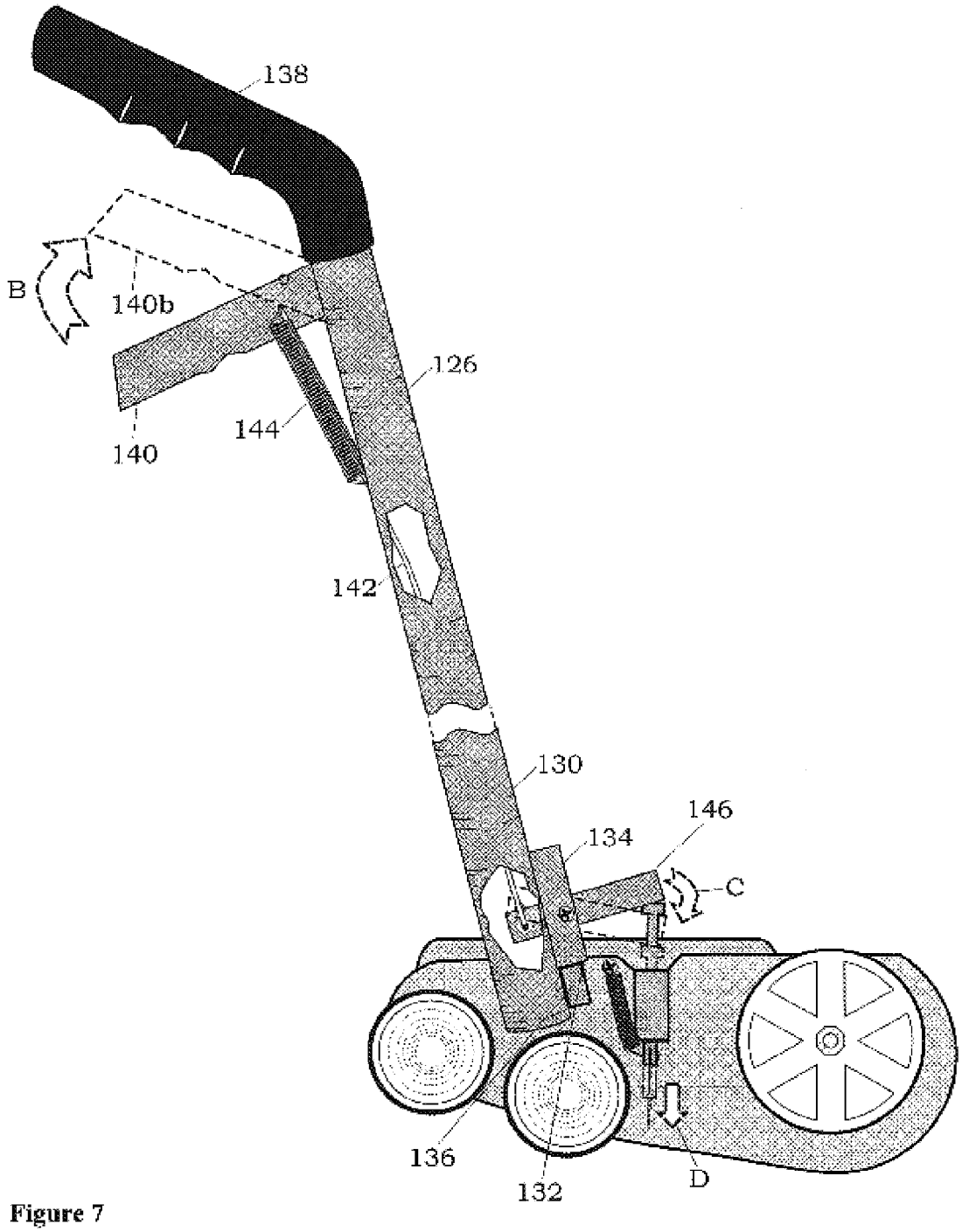
FIG. 7 is a perspective view of the applicator of FIG. 1 and its extended arm in operation on a baseboard

Referring to FIG. 6, in particular, roll holder 28 is rotatably receivable upon housing 18 by means of a suitable bolt 56 therethrough into an aperture 58 in housing 18 to be retained therein by means of a nut 60 engages centre aperture 62 of roller 28 to housing 18. Further included is a biasing means comprising a compression spring 64 disposed substantially residing therearound bolt 56 proximate outer surface 66 of bolt 56. The conventional masking tape roll 14 having a selected diameter consists of an generally cylindrical inner core 68 defining a bore 70 around which a plurality of turns of masking tape 14 are wound is detachably carried by tape roll holder 28 by engaging bore 70 of the core 68 of tape roller 72 onto cylindrical outer surface 32 of holder 28. Tape, such as roll 14, is available in various widths. Accordingly, several support holders 28 are available corresponding in length to the available widths of tape.

Guide sleeve 36 is rotatably carried on a shaft 74 which extends transversely across aperture 76 of housing 18 by a c-clip 52 and a washer 78 in accordance with conventional practice. Aperture 76 is small enough to retain sleeve 36 through shaft 74 so that the sleeve 36 will be rotatably retained therein. Guide sleeve 36 has a pair of circumferential grooves 80 and 82 at end sleeve portions 84, 86 of outer surface 88 to receive press rubbers 90, 92 which are preferably formed of a medium hard thermoplastic rubber. Guide sleeve 36 with rubbers 90, 92 serves to adequately press the edges 94, 96 of the masking tape 14 thereto so as to ensure partial adhesion of the tape therealong. As the description ensures, it will become apparent to those skilled in the art that the tape pressing means has further utility in connection with the ease of removing adhesive masking tapes 14 after use providing a resilience for applying a binding pressure to the tape edge but not the full tape surfaced. Guide sleeve 38 being fixed onto housing 18 through aperture 98 by shaft 100 in accordance with conventional techniques by a washer 102 and a c-clip 54 has also a pair of circumferential grooves 104, 106 receiving two rubbers 108, 110 to provide further pressing of masking tape 14.

Figure 5:
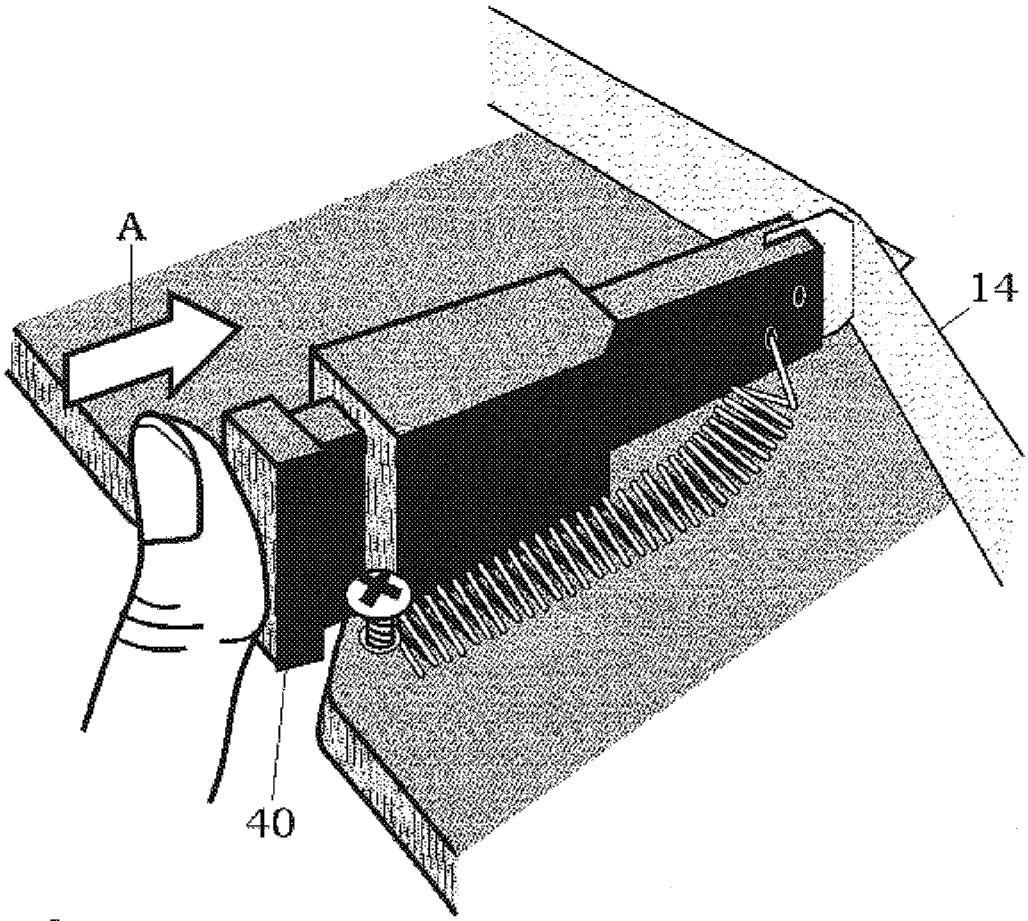
FIG. 5 is an enlarged exploded perspective view of the instant invention appearing in position relative a hand held masking machine.

As shown in FIGS. 5 and 6, the slidable body 42 of the trigger 40 can slide back and forth within the rectangular pocket 112 mounded on the forward portion 24 of housing 18 with the thumb portion 44 projecting freely through the pocket 112 with the cutter head portion 46 slidably mounted in the pocket 112 provided by the tracts with a steel blade 48 rigidly secured to the forward end slot 114 thereof to provide a sharp cutting tip 50 by a clip 116. Trigger 40 is slidably secured on housing 18 by means of a spring 118 extending between screw 120 tighten through an aperture 122 on the housing 18 and a suitable engaging aperture 124 on the cutter head portion 46 thereto. It should be understood, however, that any suitable springing arrangement which urges the trigger downwards toward the tape to be torn would be suitable.

Referring now to FIGS. 1 and 6 in a typical masking application, an extension pole 126 thereby providing the user (hot shown) with the appropriate degree of extended reach to perform a desired task such as application process to a hard to reach place such as a baseboard adjacent to the floor. Extension pole 126 comprises normally a single relatively lightweight elongated cylindrical housing 128 of appropriate length, which length may, of course, be varied according to the requisite extension distance. Extension pole 126 is adopted for quick and easy adjustment between a retracted position (solid drawings) and an pressed position (dashed objects). The pole section 130 can be securely locked onto the masker 10 to by way of a slot 132 in member 134 mounted onto member 136 of forward portion 24 of housing 18 by conventional practice. The pole 126 comprises a handle section 138 with trigger 140 adapted to be held and manipulated by a user. A cable 142 is connected to the trigger 140 by conventional practice with a bias means of tension spring 144 to move cutter 40. The second member 146, which, when in use along with trigger 40, is pivotally connected at its opposite end to a cable 142 which is, in turn, pivotally mounted at its opposite end to a trigger 140. Such an arrangement makes it possible for the operator to grasp handle section 138 and pull the trigger 140 (as indicated by arrow B) to its upmost position 206*a* (as shown in dash line) thereby urges down the triggering rod 214 (as indicated by arrow B) thereby pushes down 140*b* (as shown in dash line), forces trigger 40 to go down so as to cut tape 14. The pulling of trigger 140 serves to virtually instantaneously cutting of the tape.

It will be appreciated that while invention has been described by reference to the present contemplated preferred embodiment thereof, certain modifications and variations thereto may be practised without departing from the spirit and scope of the invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

What is claimed is:

1. An apparatus for removably applying tape to mask a surface, comprising:

(a) first means for pressing a first edge portion of the tape against the surface with a binding pressure, operable to urge the first edge portion of the tape to adhere to the surface; and (b) second means for pressing an other portion of the tape against the surface with a pressure less than the binding pressure, operable to urge the other portion of the tape to mask but not substantially adhere to the surface, wherein the second means for pressing includes a roller, the first means for pressing includes an annulus circumscribing a disc portion of the roller, and the annulus is adapted to removably engage the disc portion, being formed from a medium-hard thermoplastic and having a peripheral surface that is wide in comparison to the thickness of the annulus and substantially flat.

2. An apparatus as claimed in claim 1, wherein the disc portion has a smaller outer diameter than an adjacent portion of the roller, whereby the disc portion and the adjacent portion together define a groove for releasably retaining the annulus.

3. A system for removably applying tape to mask a surface, comprising:

(a) the apparatus of as claimed in claim 1; and (b) masking tape.

4. A system as claimed in claim 3, wherein the disc portion has a smaller outer diameter than an adjacent portion of the roller, whereby the disc portion and the adjacent portion together define a groove for releasably retaining the annulus.

5. A method of removably applying tape to mask a surface, comprising:

(a) pressing a first edge portion of the tape against the surface with a binding pressure, so as to urge the first edge portion of the tape to adhere to the surface;

(b) pressing an other portion of the tape against the surface with a pressure less than the binding pressure, so as to urge the other portion of the tape to mask but not substantially adhere to the surface, wherein pressing the other portion includes rolling over the other portion with a roller and pressing the first edge portion includes rolling over the first edge portion with an annulus that circumscribes a disc portion of the roller; and (c) removably engaging the annulus on the disc portion.

* * * * *